US005581159A

United States Patent [19]

Lee et al.

[11] Patent Number: 5,581,159

[45] Date of Patent: Dec. 3, 1996

[54] BACK-TO-BACK DIODE CURRENT REGULATOR FOR FIELD EMISSION DISPLAY

[75] Inventors: John K. Lee, Meridian; Eugene H. Cloud; David A. Cathey, Jr., both of Boise, all of Id.

[73] Assignee: Micron Technology, Inc., Boise, Id.

[21] Appl. No.: 554,853

[22] Filed: Nov. 7, 1995

Related U.S. Application Data

[63] Continuation-in-part of Ser. No. 530,562, Sep. 19, 1995, which is a continuation of Ser. No. 209,579, Mar. 11, 1994, abandoned, which is a continuation-in-part of Ser. No. 11,927, Feb. 1, 1993, Pat. No. 5,357,172, which is a continuation-in-part of Ser. No. 864,702, Apr. 7, 1992, Pat. No. 5,210,472.

[51] Int. Cl.[6] ..... H05B 41/36; H01J 17/36

[52] U.S. Cl. ..... 315/167; 315/205; 315/339; 315/349; 315/DIG. 7

[58] Field of Search ..... 315/167, 169.1, 315/169.3, 169.4, 202, 205, 320, 325, 334, 337, 339, 349, DIG. 7

[56] References Cited

U.S. PATENT DOCUMENTS

| | | | |
|---|---|---|---|
| 4,560,419 | 12/1985 | Bourassa et al. | 148/1.5 |
| 4,658,378 | 4/1987 | Bourassa | 365/154 |
| 4,679,170 | 7/1987 | Bourassa et al. | 365/154 |
| 4,908,539 | 3/1990 | Meyer | 315/169.3 |
| 4,940,916 | 6/1990 | Borel et al. | 313/306 |
| 5,103,144 | 4/1992 | Dunham | 315/366 |
| 5,157,309 | 10/1992 | Parker | 315/169.1 |
| 5,162,704 | 11/1992 | Kobori et al. | 315/349 |
| 5,210,472 | 5/1993 | Casper et al. | 315/349 |
| 5,283,500 | 2/1994 | Kochanski | 315/58 |
| 5,357,172 | 10/1994 | Lee et al. | 315/167 |
| 5,387,844 | 2/1995 | Browning | 315/169.3 |
| 5,396,150 | 3/1995 | Wu et al. | 313/495 |
| 5,410,218 | 4/1995 | Hush | 315/169.1 |

OTHER PUBLICATIONS

Kon Jiun Lee; "Current Limiting of Field Emitter Array Cathodes"; Aug. 1986; pp. iii–iv, xi–xii, 1–5, 157–162; PhD Thesis, Georgia Institute of Technology.

B. D. Loughlin et al.; "Monochrome and Color Visual Information Transmission"; pp. 4.1, 4.2, 4.19, 4.20; published as chapter 4 of Television Engineering Handbook; Benson & Whitaker, editors; 1992; McGraw–Hill, Inc.

*Primary Examiner*—David Mis
*Attorney, Agent, or Firm*—Robert J. Stern

[57] ABSTRACT

A circuit for regulating the pixel current in a field emission display so as to enhance pixel-to-pixel uniformity of pixel current. The pixel current flows through a pair of diodes connected back-to-back. A transistor circuit controls the voltage across the back-to-back diode pair, so that the voltage/current transfer characteristic of the diode pair determines the pixel current.

15 Claims, 6 Drawing Sheets

BACK-TO-BACK DIODE CURRENT REGULATOR FOR FIELD EMISSION DISPLAY

CROSS-REFERENCE TO RELATED APPLICATIONS

This application is a continuation-in-part of U.S. patent application Ser. No. 08/530,562 filed Sep. 19, 1995, which is a continuation of U.S. patent application Ser. No. 08/209,579 filed Mar. 3, 1994, now abandoned, which is a continuation-in-part of application Ser. No. 08/011,927 filed Feb. 1, 1993, now U.S. Pat. No. 5,357,172, which is a continuation-in-part of application Ser. No. 07/864,702, filed Apr. 7, 1992, now U.S. Pat. No. 5,210,472.

FIELD OF THE INVENTION

The invention relates generally to field emission displays and, more specifically, to circuitry for regulating the current flow to the pixels in the display.

BACKGROUND OF THE INVENTION

Field emission displays are desirable for use in viewfinders of video cameras and other display applications requiring low operating power and high pixel density. Such displays typically include an anode electrode coated with an cathodoluminescent phosphor, an array of field emitter tip cathode electrodes, and a perforated grid or gate electrode adjacent the emitter tips. A high positive voltage (e.g., +1,000 volts) is connected to the anode, and a lower positive voltage (e.g., +50 v.) is connected to the grid.

A pixel is the smallest independently-controllable area of the display. Each pixel includes a number of emitter tips which are controlled together. A typical field emission display has an array of tens of thousands of pixels arranged in a matrix of hundreds of rows and hundreds of columns, so that each pixel is uniquely identified by the row and column to which it belongs.

In a raster scan video system, an analog or digital video luminance signal is produced by scanning the brightness of the video image from the left-most column to the right-most column within the top row of the image, then scanning from left to right within the next lower row, and so forth until the bottom row of the image is scanned. At this point the scanning process is repeated. At any instant, the value of the video luminance signal is proportional to the brightness of the pixel at the current scan position.

A field emission display may be "active matrix" or "passive matrix". In an active matrix field emission display, each pixel includes a control circuit connected to the emitter tips in that pixel which controls the voltage at the emitter tips and the current flow through the tips. The emitter tips and control circuit are replicated at each of the thousands of pixels in the display.

In operation, when a pixel is to be dark, that pixel's control circuit raises the voltage at that pixel's emitter tips to a value close to the grid voltage. Conversely, when a pixel is to emit light, the pixel's control circuit reduces the voltage at the emitter tips to a value sufficiently lower than the grid voltage (i.e., the control circuit makes the emitter tip voltage sufficiently negative relative to the grid electrode voltage) so as to cause emission of electrons from the emitter tips. Each emitter tip emits electrons toward the grid, but almost all the electrons are accelerated by the anode voltage so as to pass through apertures in the grid and strike the phosphor coating on the anode, thereby exciting the phosphor to emit light.

An example of an active matrix field emission display is disclosed in commonly-assigned U.S. Pat. No. 5,357,172 to Lee et al., entitled "Current-Regulated Field Emission Cathodes for Use in a Flat Panel Display in Which Low-Voltage Row and Column Address Signals Control a Much Higher Pixel Activation Voltage".

One difficulty in manufacturing field emission displays is ensuring that all of the tens of thousands of pixels have a uniform brightness. The brightness of each pixel is proportional to the pixel current, defined as the total current flow through the field emitter tip cathode electrodes in that pixel. Therefore, a field emission display typically includes a circuit for regulating the pixel current. However, spatial non-uniformities inherent in semiconductor fabrication processes produce pixel-to-pixel non-uniformities in the current provided to each pixel by its associated current regulator.

One circuit for regulating the pixel current in a field emission display is disclosed in the above-mentioned U.S. Pat. No. 5,357,172 to Lee et al. In that circuit, a resistor in each pixel control circuit determines the pixel current flow, so that the pixel-to-pixel uniformity of the current depends on the pixel-to-pixel uniformity of the resistance values of the resistors. Because the pixel current in a field emission display typically is in the range of only 0.1 to 300 nA, the resistors must have resistance values on the order of $10^8$ to $10^{11}$ ohms. Unfortunately, it is difficult to manufacture such high value resistors with the desired uniformity.

U.S. Pat. No. 5,396,150 to Wu et al. discloses a field emission display employing a separate resistor in series with each field emitter tip for the stated purpose of "obtaining emission uniformity by sustaining the cathode to gate voltage". Because Wu has one resistor per emitter tip rather than one resistor per pixel as in Lee et al., Wu's resistors each conduct less current than Lee's for a given pixel brightness, hence must have even higher resistance than Lee's. Consequently, Wu's resistors are subject to the same or worse non-uniformity problems as those in the Lee et al. disclosure.

The PhD thesis "Current Limiting of Field Emitter Array Cathodes" by Kon Jiun Lee (Georgia Institute of Technology, August 1986) also discloses a field emitter array having a resistor in series with each field emitter tip for the purpose of improving emission uniformity. The resistors having values on the order of $10^8$ to $10^9$ ohms were fabricated of undoped, intrinsic silicon. The thesis also proposed that a reverse-biased p-n junction diode, either alone or in combination with a resistor, was expected to be superior to a resistor alone if a p-n junction could be successfully fabricated which could tolerate practical current and temperature levels without reversible breakdown. The thesis proposed fabricating the diode of Ge, PbS, or InSb because a silicon diode would have too low a reverse-biased saturation current.

Three other circuits for regulating the pixel current in a field emission display are disclosed in U.S. Pat. No. 5,162,704 to Kobori et al., entitled "Field Emission Cathode". FIGS. 1 and 2 of Kobori show a reverse-biased Schottky diode connected in series between each emitter tip and a cathode electrode to regulate the pixel current. FIG. 3 of Kobori shows a current regulator circuit having a field-effect transistor (FET) and a resistor which can be substituted for the Schottky diode. Undesirably, the designs of Kobori's FIGS. 1–3 seek to maintain a constant current in each emitter tip, thereby making the designs unsuitable for displays which vary the amplitude of current in each pixel in response to a video luminance signal. (That is, the designs could be used only in displays which vary the duty cycle, rather than the amplitude, of the pixel current in response to the luminance signal.) In addition, the FET/resistor design in Kobori's FIG. 3 has the same disadvantage as U.S. Pat. No. 5,357,172, namely, that the pixel current uniformity depends on the uniformity of resistors in the Gigohm range. Another design shown in FIG. 4 of Kobori requires bipolar transistors, which would be undesirable for use in a display which uses field-effect transistors in other parts of the display circuit, because fabricating both types of transistors on a substrate typically requires a more complex fabrication process with additional fabrication steps.

SUMMARY OF THE INVENTION

Our invention is a circuit for regulating the pixel current in a field emission display in which the pixel current flows through a pair of diodes connected back-to-back. A transistor circuit controls the voltage across the back-to-back diode pair, so that the voltage/current transfer characteristic of the diode pair determines the pixel current. We have found that, at the voltage and current amplitudes suitable for field emission displays, the back-to-back diode pair enables superior pixel-to-pixel uniformity of pixel current.

DETAILED DESCRIPTION OF THE PREFERRED EMBODIMENTS

Principles of the Invention

Figure 1:
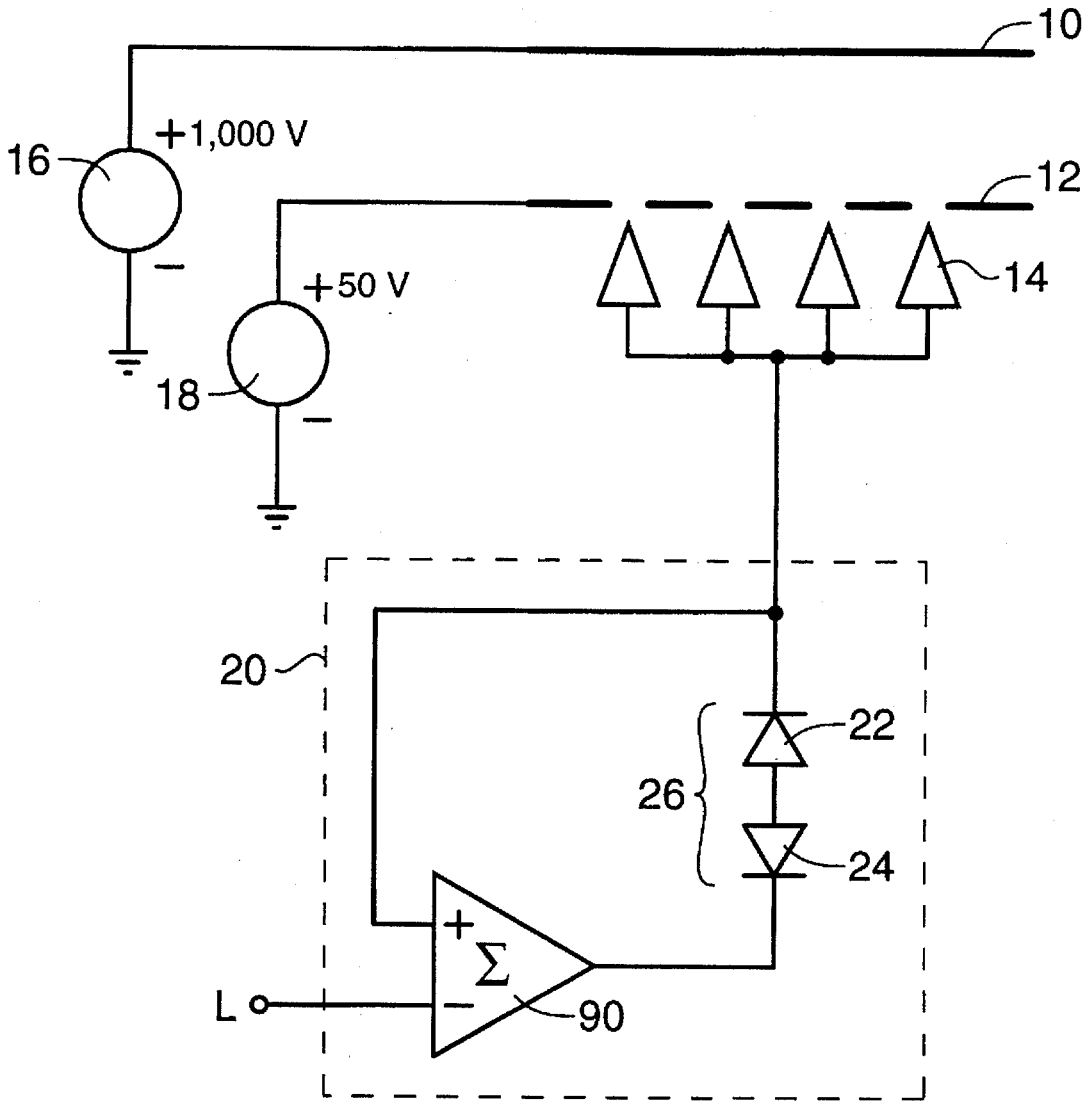
FIG. 1 is an electrical schematic diagram of a pixel in an active matrix field emission display having a pixel current control circuit employing back-to-back diodes in accordance with the invention.

FIG. 1 shows the circuitry for one pixel of a field emission display which includes the present invention. The phosphor-coated anode 10, grid electrode 12, and field emitter tips 14 may be of any conventional design, such as described in the Background of the Invention. A conventional anode voltage source 16 supplies a high, positive voltage (for example, +1000 volts) to the anode 10, and a conventional grid voltage source 18 supplies a moderate, positive voltage (for example, +50 v.) to the grid 12. Examples of the these components are described the above-mentioned, commonly-assigned U.S. Pat. No. 5,357,172 to Lee et al., the entire contents of which are hereby incorporated into the present application.

Each pixel includes a number of emitter tips 14 which are controlled together. A pixel control circuit 20 controls the current through the emitter tips 14 within the pixel (thereby controlling the brightness of the pixel) in response to a luminance signal L. In the illustrated embodiment, each pixel has four emitter tips 14 which are connected directly to each other and to the pixel control circuit. The emitter tips 14 and control circuit 20 are replicated at each of the thousands of pixels in the display.

The luminance signal L may be generated by any conventional video decoder circuit. Examples of video decoders are described in commonly assigned, copending application Ser. No. 08/372,413 filed Jan. 13, 1995 by Hush et al. for "Timing Control for a Matrixed Scanned Array"; and in U.S. Pat. No. 5,103,144 issued Apr. 7, 1992 to Dunham. The entire contents of both of these documents are incorporated by reference into the present application.

The control circuit 20 includes two semiconductor diodes 22, 24 connected back-to-back to form a back-to-back diode pair 26. The two diodes 22, 24 may be connected together either at their respective anodes as illustrated in FIG. 1, or at their respective cathodes (not shown).

Different embodiments of the pixel control circuit 20 are described below. The embodiments share the following operating principles: A "voltage control" portion of the pixel control circuit 20 applies a voltage across the back-to-back diode pair 26 which is proportional to the luminance signal L. Accordingly, the current through the back-to-back diode pair is a function of this voltage as determined by the current-voltage transfer characteristic of the back-to-back diode pair. A "current control" portion of the pixel control circuit maintains the current through the emitter tips as equal to the current through the back-to-back diode pair 26. Consequently, the current through the emitter tips is a function of the luminance signal L, this function being determined by the current-voltage transfer characteristic of the back-to-back diode pair.

Advantageously, the current-voltage transfer characteristic of the back-to-back diode pair 26 within each pixel can be made very uniform from pixel to pixel within a display. This enables excellent pixel-to-pixel uniformity of display brightness.

The specific embodiment shown in FIG. 1 employs a conventional unity-gain voltage amplifier circuit 90 having differential inputs. The inverted input (–input) of the amplifier 90 is connected to receive the luminance voltage L for that pixel. One end of the back-to-back diode pair 26 is connected to the output of the amplifier 90, and the other end of the back-to-back diode pair 26 is connected to both the uninverted input (+input of the amplifier and the emitter tips 14.

To operate as described in the following paragraph, the amplifier 90 should have an input impedance at least one or two orders of magnitude greater than the impedance of the back-to-back diode pair 26; this condition is achieved readily by conventional amplifiers having a MOSFET input stage fabricated in single-crystal silicon. Similarly, the amplifier 90 also should have an output impedance at least one or two orders of magnitude less than the impedance of the diode pair 26; this is satisfied by almost any conventional amplifier because the diode pair impedance is so high.

In operation, the amplifier 90 controls the voltage across the back-to-back diode pair 26 so as to be equal to the luminance voltage L, irrespective of the voltage at the emitter tips 14. All current from the emitter tips 14 flows through the diode pair 26 to the output of the amplifier. Consequently, the emitter tip current is controlled by (i.e, equals) the diode current, and the diode current is determined by the luminance voltage L and the current-voltage transfer characteristic of the back-to-back diode pair.

Figure 2A:
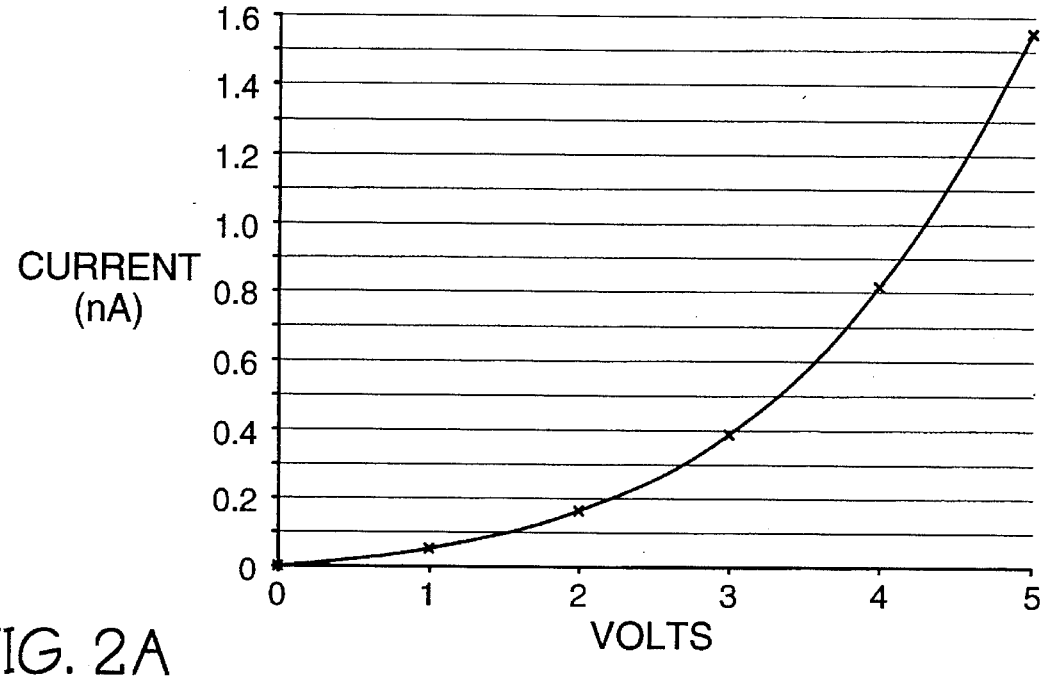
FIGS. 2A and 2B are linear and logarithmic graphs, respectively, of the current-voltage transfer characteristic of a polysilicon back-to-back diode pair.
Figure 2B:
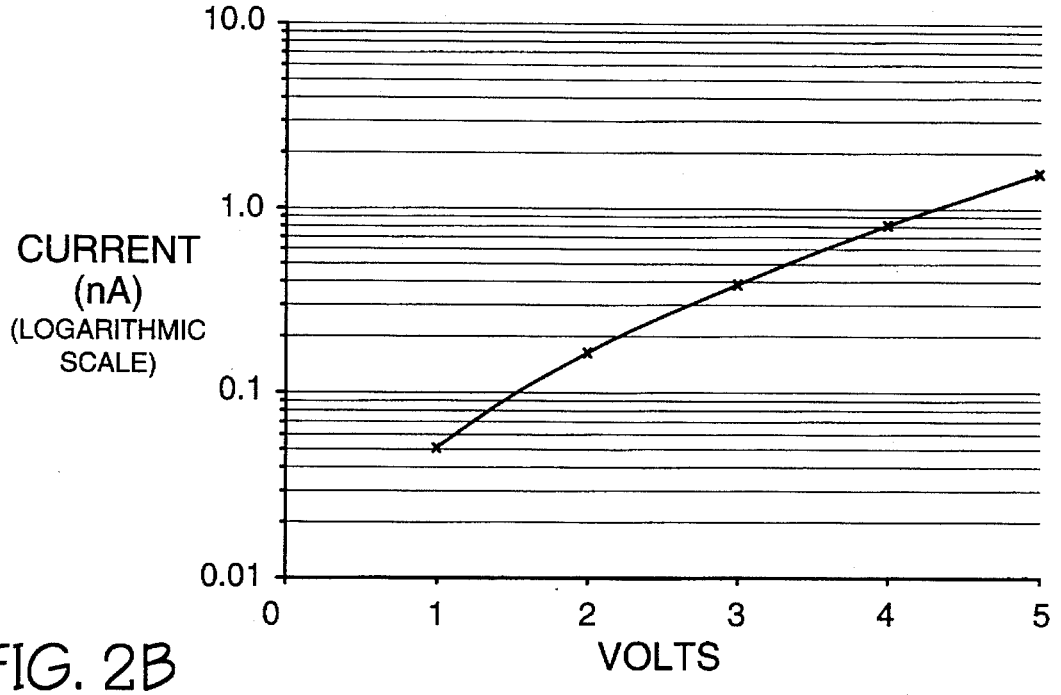

The current-voltage transfer characteristic of each back-to-back diode pair 26 must be such that diode voltages spanning a range of voltages which can be provided by the luminance signal L will produce diode currents spanning a range of useful pixel currents, that is, a range of pixel currents producing a useful dynamic range in display brightness. We used polysilicon junction diodes to achieve a useful range of diode currents of 0.05 to 0.8 nA over a diode pair voltage range of 1 to 4 volts, as shown in FIG. 2. If one wanted to operate the diode pair at a maximum voltage of 5 volts, the maximum pixel current would double to 1.55 nA. Single-crystal silicon junction diodes would be expected to have reverse-biased leakage currents too low to supply adequate current to the emitter tips. Amorphous silicon diodes and micro-crystalline diodes would be suitable alternatives, depending on the desired emitter tip current.

The pixel-to-pixel uniformity of pixel brightness in this control circuit is determined by the pixel-to-pixel uniformity (i.e., device-to-device uniformity) of the current-voltage transfer characteristic of the back-to-back diode pair 26 in each pixel of a single display substrate, and by the pixel-to-pixel uniformity of the input and output offset voltages and gain of the amplifier 90 in each pixel of a single display substrate. We have found that the device-to-device uniformity of the current-voltage transfer characteristic of the back-to-back diode pairs 26 on a single substrate is superior to the uniformity of the current-voltage transfer characteristic of conventional reverse-biased diodes, as well as being superior to the uniformity of resistors in the required Gigohm range.

Table 1 shows the results of our uniformity tests comparing back-to-back diodes and reverse-biased diodes.

TABLE 1

| $P^-$ Doping | Back-to-Back Diode Pair | | Single Reverse-Biased Diode | |
|---|---|---|---|---|
| Implant Dose ($\times 10^{13}/cm^2$) | Mean Resistance (Gigohms) | Std. Dev./Mean ($\sigma$/m) | Mean Resistance (Gigohms) | Std. Dev./Mean ($\sigma$/m) |
| 10.0 | 2.24 | 7.6% | 5.00 | 14.8% |
| 7.5 | 2.51 | 8.1% | 5.68 | 13.4% |
| 5.0 | 3.15 | 5.6% | 8.45 | 12.8% |
| 2.5 | 4.49 | 5.8% | 13.3 | 8.4% |

The test results shown in Table 1 were obtained by fabricating four groups of silicon wafers, each group containing three or four wafers. On each wafer a polysilicon layer was deposited, and then the polysilicon was using ion implantation. Next, an array of junction diodes was fabricated by using ion implantation to create an array of $N^+$ doped regions on the $P^-$ doped polysilicon. Specifically, fifty to sixty back-to-back diode pairs and the same number of single junction diodes were fabricated on each substrate. Each of the four groups of substrates was subjected to a different ion implantation dose when creating the initial $P^-$ doped layer, so that the resulting four groups of diodes were characterized by four different levels of reverse leakage current.

Four volts was connected across each back-to-back diode pair and each reverse-biased single diode, the resulting current flow was measured, and the resistance of the diode pair or reverse-biased diode was calculated by dividing the voltage (4 volts) by the measured diode current. These measurements were repeated for about 150–250 different devices in each of the four groups, and then the mean resistance and standard deviation of resistance were computed.

Table 1 shows the results of these computations. The standard deviation of the resistance values clearly is much lower for the back-to-back diode pairs than for the reverse-biased single diodes. This means that when such devices are used to control the current flow through emitter tips in a field emission display, such as in the circuit shown in FIG. 1, the back-to-back diode pairs will produce much better pixel-to-pixel brightness uniformity across the display than the reverse-biased single diodes used in some prior art displays.

Figure 5:
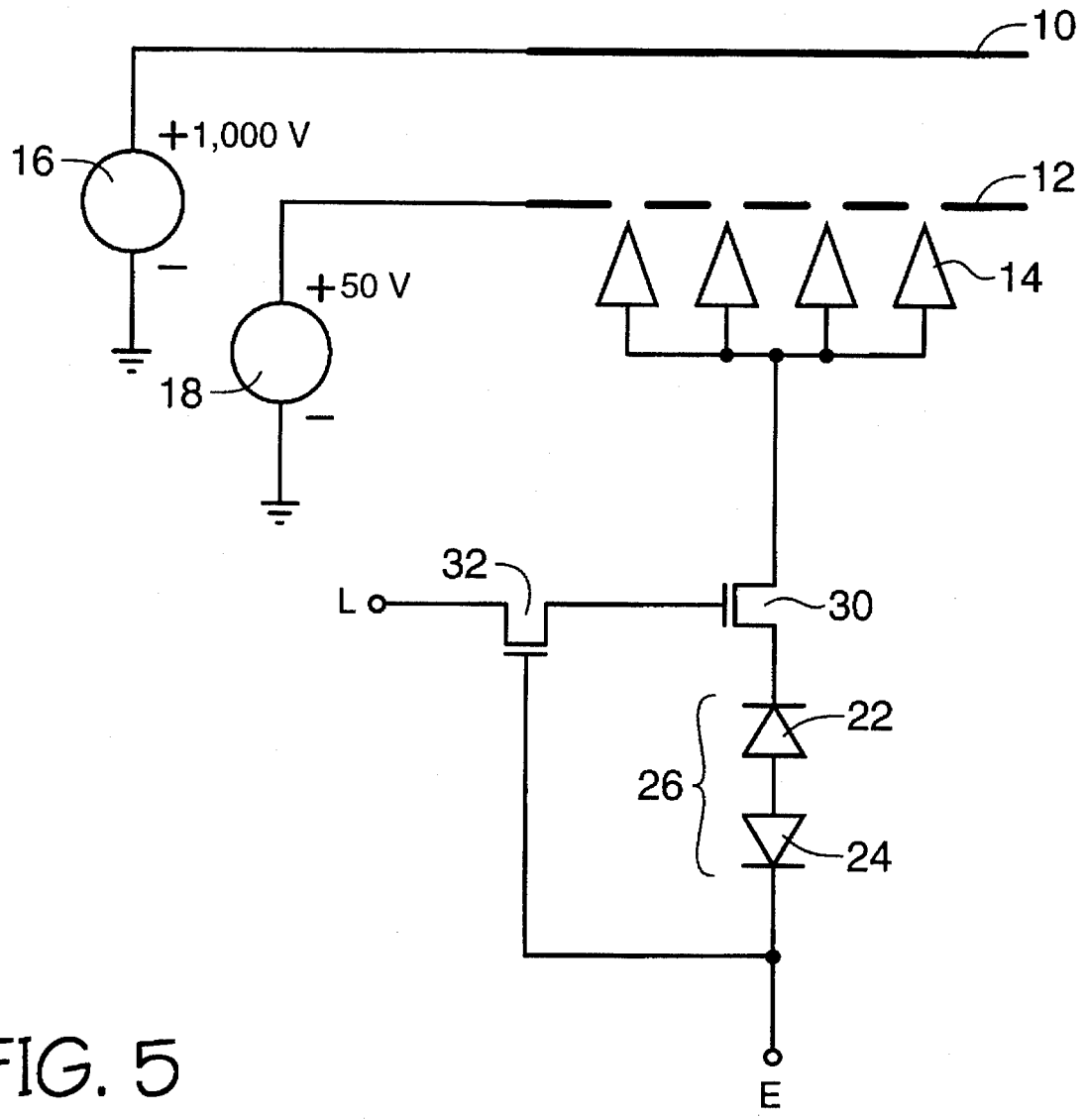
FIG. 5 is an electrical schematic diagram of another alternative embodiment of a display in which the luminance voltage is capacitively stored in the current control circuit.

(The diode resistances shown in Table 1 would be useful in a field emission display in which each of the pixels conducts current almost 100% of the time, i.e., has an almost 100% duty cycle. FIG. 5, described below, is a particularly advantageous circuit for achieving such a duty cycle in a raster scan display. In a display having smaller duty cycle for the current in each pixel, the desired resistances would be reduced proportionately. As is well known, the resistance of the back-to-back diode pair 26 can be reduced by increasing the doping level of the $P^-$ region of the polysilicon diodes.)

In the preceding discussion, we have emphasized pixel-to-pixel uniformity of the current-voltage transfer characteristic of the back-to-back diode pairs 26, but we have not yet discussed the shape of the current-voltage transfer characteristic curve, that is, whether it is linear, exponential, square law, etc. FIG. 2 shows the measured current-voltage transfer characteristic of a typical back-to-back polysilicon diode pair 26 manufactured as described above. The diode current is almost exponentially proportional to the voltage across the back-to-back diode pair. Accordingly, in the pixel control circuit 20 shown in FIG. 1, the current flow to the emitter tips 14—and hence the brightness of the pixel—will be exponentially proportional to the luminance signal L. This exponential characteristic is advantageous because human perception of brightness is believed to be approximately logarithmic. Thus, the humanly perceived brightness of the pixel will be linearly proportional to the luminance signal L.

Advantageously, the current-voltage characteristic shown in FIG. 2 also approximates the current-voltage characteristic of cathode ray tubes, in which the display brightness B is proportional to the video luminance voltage signal L raised to a power n in the range of 2 to 3, that is, $B=L^n$. (See equation [4-16] on page 4.19 of "Television Engineering Handbook", ed. K. B. Benson and J. C. Whitaker, pub. McGraw-Hill, 1992.) The current-voltage characteristic shown in FIG. 2 is a reasonable fit to this power function, with the power n roughly equal to 2.2.

Optionally, a conventional transistor switch can be added to the circuit shown in FIG. 1 to selectably enable and disable current flow to the emitter tips in response to an "enable" logic signal. The switch can be inserted between the diode pair 26 and the emitter tips 14, between the diode pair 26 and the output of the amplifier 90, or between the inverting input of the amplifier 90 and a zero or negative reference voltage source. The enable signal and the transistor switch can be the same as the enable signal E and the transistor 32 shown in FIGS. 3 and 5, as described below.

Preferred Embodiments with FET

Figure 3:
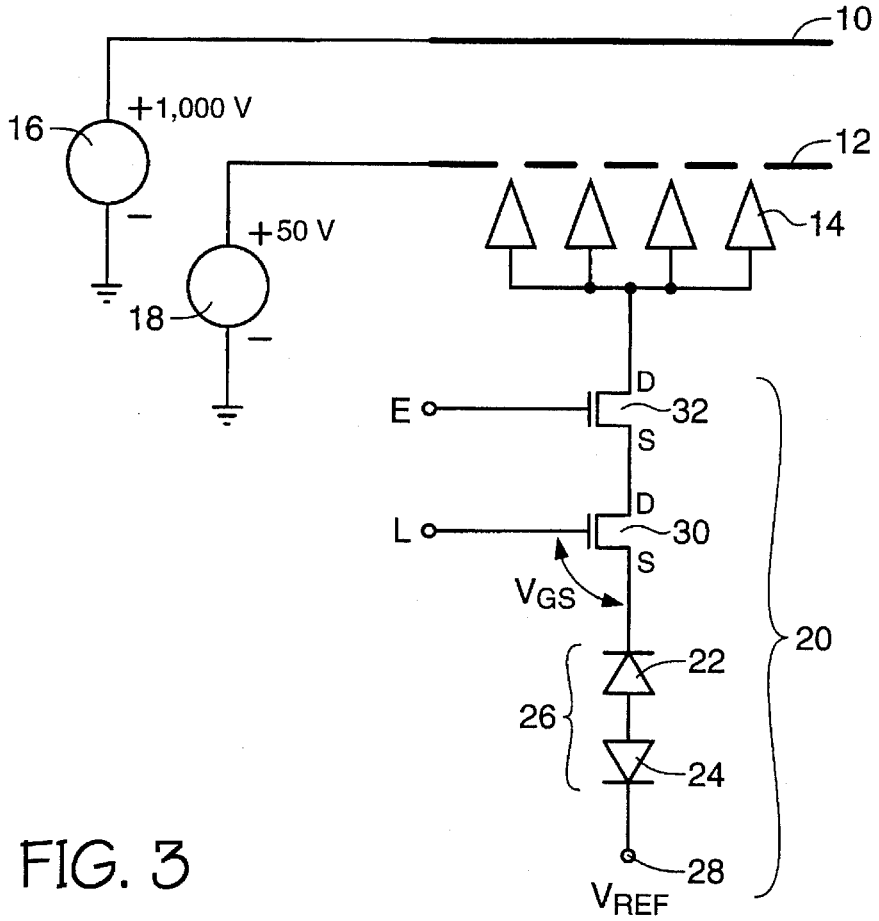
FIG. 3 is an electrical schematic diagram of a preferred embodiment of the invention employing a field effect transistor.
Figure 4:
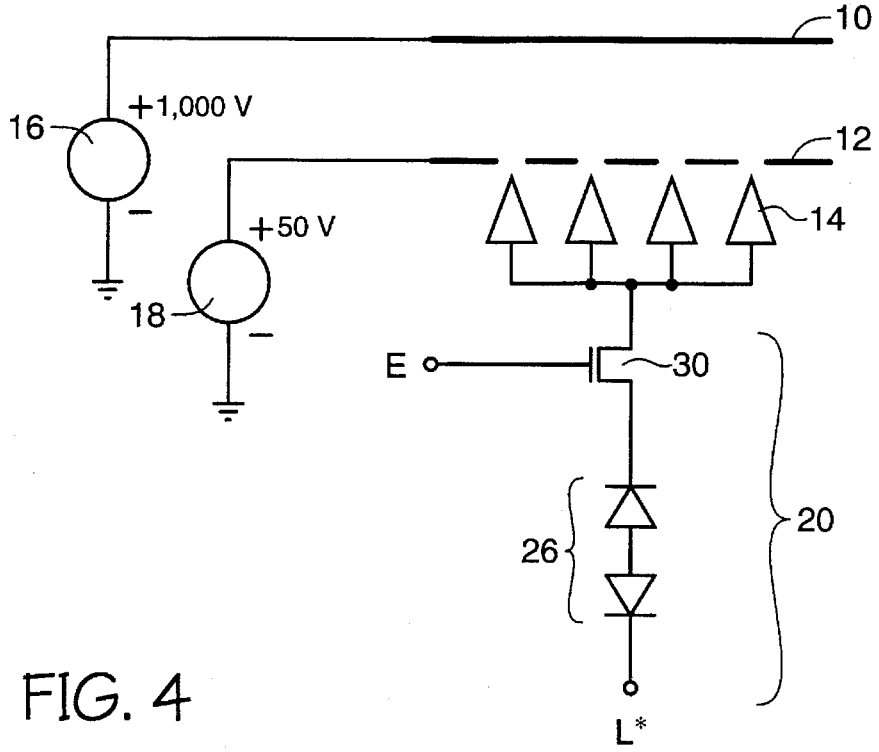
FIG. 4 is an electrical schematic diagram of an alternative embodiment of a display in which the luminance signal supplies current to the emitter tips.

FIGS. 3 and 4 show pixel control circuits 20 having a topology different from that shown in FIG. 1. Presently, the topology of FIGS. 3 and 4 is prefected because it can be implemented with a single field-effect transistor (FET) 30 instead of the voltage amplifier 90 shown in FIG. 1.

In the topology of FIGS. 3 and 4, the voltage across the back-to-back diode pair 26 is controlled by a field-effect transistor (FET) 30 connected between the diode pair and the emitter tips 14. This contrasts with the topology of FIG. 1 in which one end of the back-to-back diode pair 26 is connected to the emitter tips 14, and the voltage across the back-to-back diode pair 26 is controlled by a unity-gain amplifier 90 whose output connects to the opposite end of the diode pair 26.

FET Circuit Controlled by Uninverted Luminance Signal

In the embodiment shown in FIG. 3, the back-to-back diode pair 26 is connected between the source of a field-effect transistor (FET) 30 and a reference voltage source 28. In the preferred embodiment, the reference voltage $V_{REF}$ equals zero volts, and the reference voltage source 28 is simply electrical ground. The gate of the FET 30 is connected to receive a luminance voltage signal L.

The first FET 30 is characterized by a threshold voltage $V_T$ such that the FET 30 does not conduct current between its source and drain when $V_{GS}$ (the FET's gate voltage $V_G$ minus the FET's source voltage $V_S$) is less than $V_T$. Conversely, when $V_{GS}$ exceeds $V_T$, the channel resistance of the FET 30—i.e., the resistance between the source and the drain—sharply drops to a value orders of magnitudes less than the resistance of the back-to-back diode pair 26.

The drain of the FET 30 can be connected directly to the emitter tips 14. However, in the illustrated embodiment, a second FET 32 is connected in series between the emitter tips 14 and the drain of the first FET 30 to provide an optional "enable" control input.

The gate of the second FET 32 is connected to receive an "enable" logic signal E. In the "enable" state, the enable logic signal has a high voltage value (for example, +5 volts) which turns on the second FET 32 so as to conduct current between the first FET 30 and the emitter tips 14. In the "disable" state, the enable logic signal has a low voltage value (for example, zero volts) which turns off the second FET 32 to prevent current flow to the emitter tips 14. Accordingly, when the enable signal E is high, the first FET 30 controls the current flow to the emitter tips 14 in response to the luminance signal L. When the enable signal E is low, the current flow to the emitter tips 14 is zero, notwithstanding the value of the luminance signal L.

During times when the enable signal E is high (or at all times in embodiments which omit the second FET 32), the luminance signal L controls the current flow to the emitter tips 14 as follows: The luminance signal L is a voltage $V_L$ which is proportional to the desired brightness or luminance of the pixel. When the luminance signal is close to zero—specifically, when $V_L<(V_T+V_{REF})$, so that $V_{GS}<V_T$—the first FET 30 is turned off (i.e., has a very high channel resistance) so as to prevent current flow to the emitter tips 14. Conversely, when the luminance signal is positive—specifically, when $V_L>(V_T+V_{REF})$, so that $V_{GS}>V_T$—the channel resistance of the first FET 30 drops to a value orders of magnitude less than the resistance of the back-to-back diode pair 26. In this condition, the FET 30 functions as a voltage regulator, maintaining its source voltage $V_s$ at a level equal to the luminance signal voltage $V_L$ minus the threshold voltage $V_T$. Thus, the voltage $V_{BB}$ across the back-to-back diode pair 26 equals $V_S$ minus $V_{REF}$; that is, the voltage across the back-to-back diode pair equals $V_L-(V_T+V_{REF})$. Therefore, the first FET 30 applies a voltage $V_{BB}$ across the back-to-back diode pair which is directly proportional to the luminance voltage $V_L$.

In response to the voltage $V_{BB}$ across the back-to-back diode pair 26, the current through the back-to-back diode pair is uniquely determined by the voltage-current transfer characteristic of the back-to-back diode pair. The reference voltage source 28 (simply electrical ground in the illustrated preferred embodiment) is the only source of current flow to the emitter tips 14, and the only path for current flow between the voltage source 28 and the emitter tips is through the back-to-back diode pair 26. Therefore, the back-to-back diode pair 26 determines the current flow through the emitter tips 14.

In summary, in the embodiment of the pixel control circuit 20 shown in FIG. 3, the first FET 30 turns off current flow to the emitter tips 14 when the luminance voltage $V_L<(V_T+V_{REF})$. Conversely, when $V_L>(V_T+V_{REF})$, the FET 30 establishes the voltage $V_{BB}$ across the back-to-back diode pair 26 as equal to $V_L-(V_T+V_{REF})$, i.e., as directly proportional to $V_L$. In response to this voltage $V_{BB}$, the current-voltage transfer characteristic of the back-to-back diode pair 26 uniquely determines the current through the diode pair 26, and hence the current through the emitter tips 14 of that pixel.

The pixel-to-pixel uniformity of pixel brightness is determined by the pixel-to-pixel uniformity (i.e., device-to-device uniformity) of the threshold voltage $V_T$ of the FET 30 in each pixel of a single display substrate, and by the pixel-to-pixel uniformity of the current-voltage transfer characteristic of the back-to-back diode pair 26 in each pixel of a single display substrate. Conventional semiconductor fabrication processes can achieve excellent device-to-device uniformity of the threshold voltage among each FET 30 on a substrate. Furthermore, we have found that the device-to-device uniformity of the current-voltage transfer characteristic of the back-to-back diode pairs 26 on a single substrate is superior to the uniformity of the current-voltage transfer characteristic of conventional reverse-biased diodes, as well as being superior to the uniformity of resistors in the required Gigohm range.

In one possible modification of the FIG. 3 circuit, the second FET 32 can be omitted, and an inverted enable logic signal E* can be connected to point 28 in place of the fixed voltage $V_{REF}$. The enable signal E* should have a low voltage value and a high voltage value corresponding to the pixel being enabled and disabled, respectively. The low voltage ("enabled") value, which enables current to flow to the emitter tips, should equal $V_{REF}$ in the original FIG. 3 circuit (for example, zero volts in the preferred embodiment). The high voltage ("disabled") value should be a more positive voltage greater than the maximum luminance voltage $V_L$ minus the threshold voltage $V_T$ of transistor 30, so as to disable current flow to the emitter tips.

FET Circuit Controlled by Inverted Luminance Signal

FIG. 4 shows an alternative embodiment of a pixel control circuit 20 in which the connections of the luminance signal L and the reference voltage source $V_{REF}$ are interchanged. Specifically, an inverted luminance signal L* is connected to the second diode 24. The luminance signal L* is considered "inverted" because the value of its voltage $V_L$* corresponding to maximum pixel brightness is more negative (i.e., less positive) than the value of its voltage $V_L$* corresponding to minimum brightness. In this description, an asterisk (*) superscript denotes a logically inverted signal.

In contrast, in the preferred embodiment previously described (FIG. 3), the luminance signal L is referred to as "uninverted" because the luminance voltage $V_L$ is zero when the pixel is to have maximum brightness, and it is a maximally positive value, such as +4 or +5 volts, when the pixel is to have minimum or zero brightness.

In the FIG. 4 embodiment, the "inverted" luminance signal L* supplies the current to the emitter tips 14. Therefore, the video decoder circuit (not shown) which supplies the luminance signal to each pixel must be capable of supplying the maximum current flow through the maximum number of pixels which may conduct current at any point in time. However, this is an easy requirement to satisfy in many commercially practical displays, because good display brightness is achieved with much less than one microampere of current flow through each pixel.

As shown in FIG. 4, an enable logic signal E is connected to the gate of the FET 30. The enable signal applied to a given pixel has a voltage $V_E$ which is negative or low (for example, zero volts) when that pixel is to be disabled (i.e., turned off), and which is a higher voltage $V_{REF}$ (for example, 5 volts) when that pixel is to be enabled (i.e., turned on). Specifically, to ensure that the low value of the enable voltage $V_E$ always disables the pixel, the low value of the enable voltage $V_E$ should be less than the lowest possible value of the luminance voltage $V_L$*(the latter being the value of $V_L$* which would produce maximum pixel brightness when $V_E$ is high to "enable" the pixel). Conversely, the high value $V_{REF}$ Of the enable voltage $V_E$ should be approximately equal to, or somewhat less than, the sum of the threshold voltage $V_T$ of FET 30 and the highest value of the luminance voltage $V_L$* (corresponding to minimum or zero pixel brightness), so that the transistor 30 will be turned off, or close to a turned off condition, when the luminance voltage Vt., is close to its highest voltage value.

In operation, when the enable logic signal is low, the FET 30 is turned off so that no current can flow through the emitter tips 14, hence the pixel is disabled. When the enable logic signal is high (that is, when $V_E=V_{REF}$), the voltage $V_{BB}$ across the back-to-back diode pair 26 is ($V_E-V_T-V_L$*). Consequently, similarly to the FIG. 3 embodiment, the voltage across the back-to-back diode pair 26 is directly proportional to $-V_L$*. As in the FIG. 3 embodiment, the current-voltage transfer characteristic of the diode pair 26 uniquely determines the current through the diode pair 26 in response to this voltage $V_{BB}$, and the current through the emitter tips equals the current through the diode pair. Therefore, the current-voltage transfer characteristic of the back-to-back diode pair 26 uniquely determines the current through the emitter tips 14 of a pixel in response to the inverted luminance signal L*.

Alternatively, if there is no need to control the pixel with an "enable" logic signal, the embodiment shown in FIG. 4 can be modified by connecting the gate of the FET 30 to a fixed voltage source which provides the previously defined voltage $V_{REF}$.

Higher Duty Cycle Embodiment

FIG. 5 shows the back-to-back diodes of the present invention incorporated in an inventive pixel control circuit which is described and claimed in the commonly-assigned U.S. patent application filed by Glen Hush concurrently with the present application, entitled "Field Emission Display With Binary Address Line Supplying Emission Current", the entire contents of which are hereby incorporated into the present application. As in the FIG. 3 embodiment, the enable logic signal E connects to the gate of the second transistor 32. The high and low voltage values of the enable signal E should be as described in the immediately preceding paragraph.

In the FIG. 5 pixel control circuit, when the enable voltage E is high, the second transistor 32 connects the luminance signal L (i.e., the voltage $V_L$) to the gate of the first transistor 30, thereby charging up the gate capacitance of the first transistor 30 to the value of the luminance voltage $V_L$. (An external capacitor can be connected to the gate of the first transistor if the intrinsic gate capacitance is insufficient to hold the voltage during the period the enable voltage is low.) When the enable voltage E is low ($E=V_{REF}$), the first transistor 30 conducts current to the emitter tips 14. As in the embodiments of FIGS. 3 and 4, the voltage across the back-to-back diode pair 26 equals $[V_L-(V_{REF}+V_T)]$, and the current to the emitter tips is determined by the current-voltage transfer characteristic of the back-to-back diode pair 26.

As explained in detail in the Hush patent application, the FIG. 5 pixel control circuit enables achieving an approximately 99% duty cycle of current to the emitter tips in a raster scan video display. Specifically, if the enable signal E connected to each pixel control circuit is a row enable signal which is high during the scanning of the row containing that pixel, then the pixel will be on during the scanning of all other rows, and the duty cycle of pixel current will be (M−1/M, where M is the number of rows in the raster scan display.

As stated earlier, various circuits for generating the above-mentioned enable logic signals and luminance voltages are well known in the field of video displays.

Passive Matrix Displays

The previously described embodiments of FIGS. 1, 3 and 4 show the invention used to improve the pixel-to-pixel brightness uniformity of a conventional active matrix field emission display, that is, a display in which a pixel control circuit 20 containing at least one transistor 30 is fabricated at the site of each pixel. The invention is equally useful to improve a conventional passive matrix field emission display, as illustrated in FIG. 6, in which there is no transistor at the site of each pixel.

Figure 6:
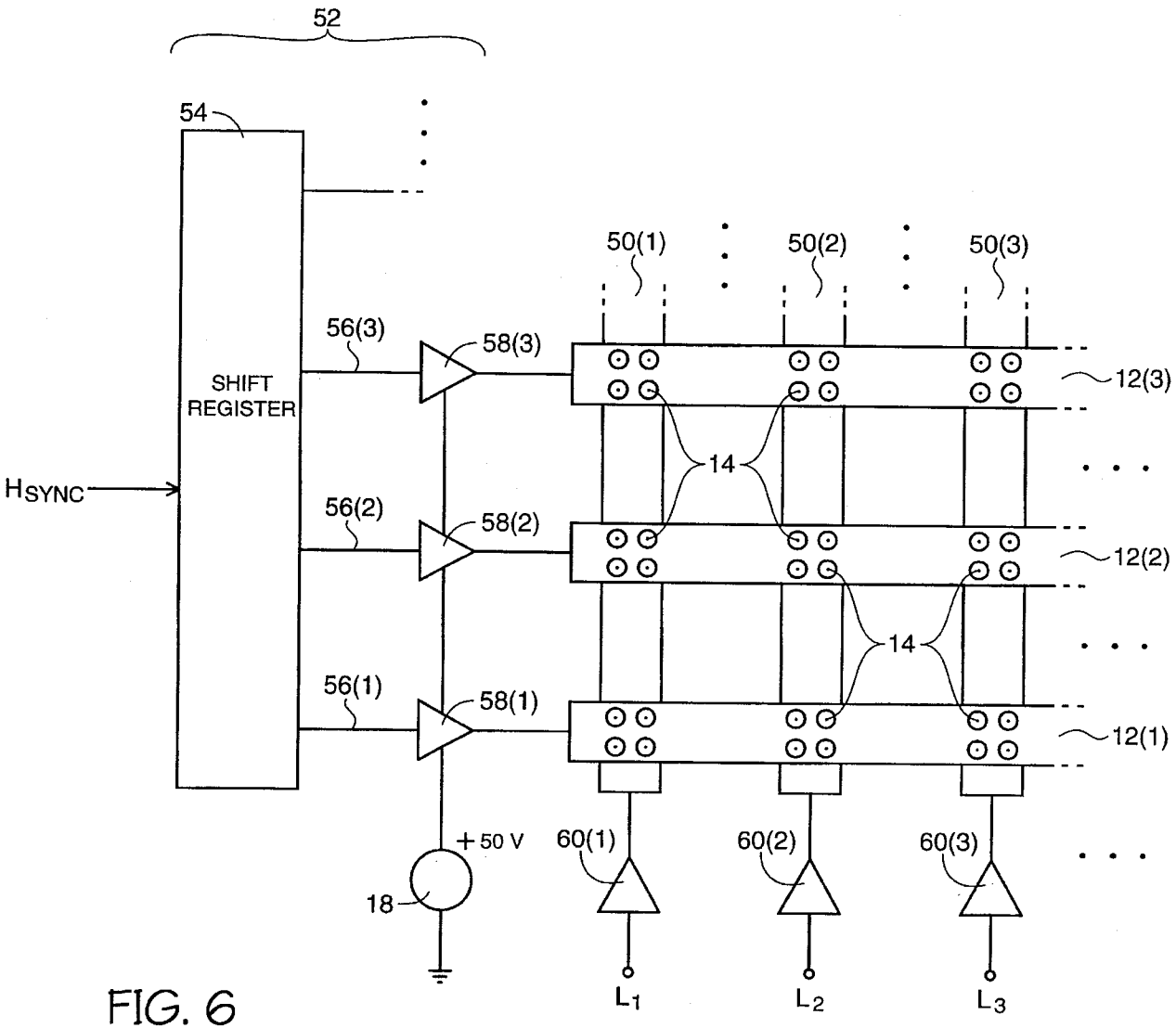
FIG. 6 (PRIOR ART)
FIG. 6 is an electrical schematic diagram of a prior art passive matrix display.

As in an active matrix display, a passive matrix display generally has a rectangular array of pixels arranged in orthogonal rows and columns, as shown in FIG. 6. If there are M rows and N columns, the number of pixels is M times N. There may be any number of emitter tips 14 in each pixel.

Unlike an active matrix display, in a passive matrix display the perforated grid or gate electrode 12 typically is divided into an array of M parallel row conductors 12(1), 12(2), 12(3), . . . 12(M). Orthogonal to the grid row conductors is an array of N parallel column conductors 50(1), 50(2), 50(3), . . . 50(N). Near the intersection of each row conductor 12 and column conductor 50, one or more emitter tips 14 (four tips, in the illustrated embodiment) is mounted on and electrically connected to the nearest column conductor 50.

A row control circuit 52 applies the grid voltage to only one of the row conductors 12 at a time. More specifically, a shift register or demultiplexer circuit 54 has M logical output lines 56(1), 56(2), 56(M). The shift register 54 outputs a logic "one" value on only one output line 56 at a time, and outputs a logic "zero" on the others. In response to a horizontal synchronization signal $H_{sync}$ received by the shift register 54 from the display's video decoder circuit (not shown), the shift register sequentially steps through each of the M outputs 56, providing a logic "one" to each output 56 in sequence.

An array of M driver amplifiers 58(1), 58(2), . . . 58(M) is connected respectively between the M shift register outputs 56(1)–56(M) and the M row conductors 12(1)–12(M). Each driver amplifier 58 receives power from the grid voltage source 18. Each driver amplifier 58(i), for each integer i from 1 to M, transfers the output voltage of the grid voltage source to its corresponding row conductor 12(i) when the logic signal 56(i) it receives from the shift register 54 is logic "one". Otherwise, each driver amplifier 58 outputs zero volts to its corresponding row conductor 12.

An array of N column luminance control circuits 60(1), 60(2), . . . 60(N) are respectively connected to the N column conductors 50(1), 50(2) . . . 50(N). Each luminance control circuit 60(i), for each integer i from 1 to N, receives at its input a luminance signal L(i) whose value at any point in time is proportional to the intended brightness of the pixel at the i-th column of the k-th row, where k designates the one of the M rows which is enabled at that point in time.

The components of the passive matrix display described above are conventional, and they can be implemented in accordance with any conventional passive matrix field emission display design. Examples of suitable designs are disclosed in U.S. Pat. No. 4,908,539 issued Mar. 13, 1990 to Meyer (see especially FIG. 12 and the description at column 7, line 53 to column 8, line 37) and in U.S. Pat. No. 5,103,144 issued Apr. 7, 1992 to Dunham. The entire disclosures of both of these patents are hereby incorporated by reference into the present patent application.

Invention Embodiments for Passive Matrix Displays

In our invention the N conventional column luminance control circuits 60(1), 60(2), . . . 60(N) of the illustrated prior art are respectively replaced by N pixel current control circuits 20(1), 20(2), . . . 20(N) employing back-to-back diode pairs 26(1), 26(2), . . . 26(N) for current regulation, preferably in accordance with one of the embodiments of FIGS. 1, 3, or 4 described above. To achieve the desired device-to-device uniformity, the N back-to-back diode pairs 26(1)–26(N) all should be fabricated on a single semiconductor substrate.

Figure 7:
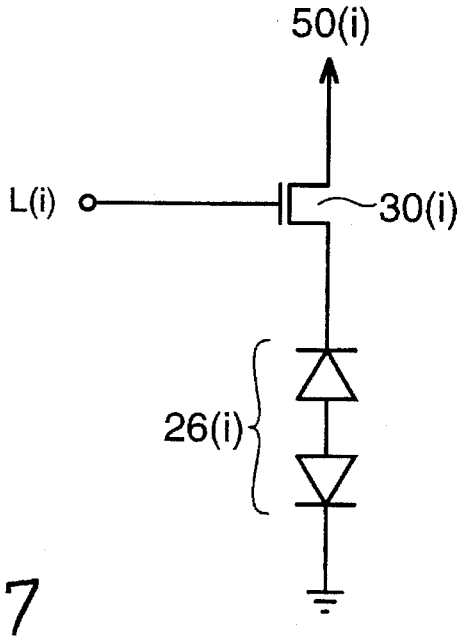
FIG. 7 is an electrical schematic diagram of a pixel current control circuit which can be substituted for the column luminance control circuit of the display shown in FIG. 5.
Figure 8:
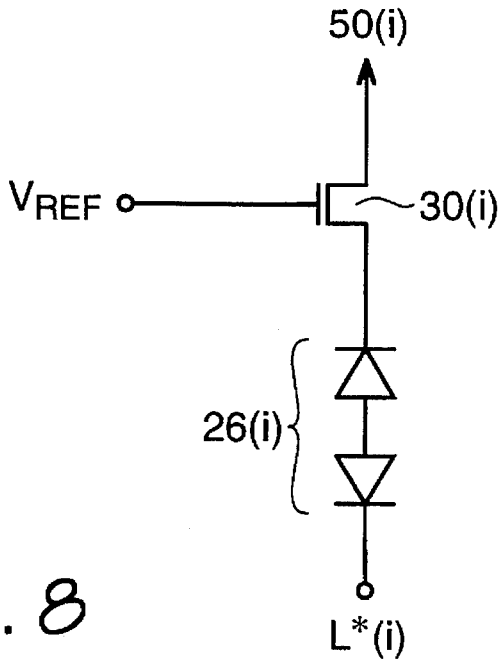
FIG. 8 is an alternative embodiment of the circuit shown in FIG. 6.

The enable input E, identified as optional in the embodiments of FIGS. 3 and 4, is not needed in a pixel Current control circuit 20 to be used in the passive matrix display of FIG. 6. FIG. 7 shows a pixel control circuit 20 based on the embodiment of FIG. 3, but omitting the second FET 32 and the enable input. FIG. 8 shows a pixel control circuit 20 based on the embodiment of FIG. 4, but in which the gate of the FET 30 is connected to receive a reference voltage $V_{REF}$ instead of an enable signal. The reference voltage $V_{REF}$ in the FIG. 7 embodiment should be the same as the "high" voltage value $V_{REF}$ of the enable signal $V_E$ in the FIG. 3 embodiment described above.

The design considerations and principles of operation of the pixel control circuits 20 shown in FIGS. 7 and 8 are the same as those described earlier for the pixel control circuits 20 shown in FIGS. 3 and 4, respectively. In particular, the FIG. 8 embodiment requires the same inverted luminance signal L* as the FIG. 4 embodiment.

In FIGS. 7 and 8, the (i) suffix after each drawing element number denotes that the figure represents the pixel control circuit 20(i) in the i-th column of the display, where i is any integer from 1 to N. The i-th pixel control circuit 20(i) receives the i-th luminance signal L(i) and supplies current to the emitter tips 14 connected to the i-th column conductor 50(i). The circuit shown in FIG. 7 or 8 is replicated N times in place of each respective luminance control circuit 60(1), 60(2), . . . 60(N) in the passive matrix field emission display of FIG. 6.

Because of the superior uniformity of the current-voltage transfer characteristic of the N back-to-back diode pairs, a passive matrix display employing the invention can achieve column-to-column brightness uniformity superior to that achieved by typical prior art column luminance control circuits 60.

A pixel control circuit 20 having the topology shown in FIG. 1 is also suitable for use in a passive matrix display. One pixel control circuit of FIG. 1 would be substituted for each column control circuit 60 shown in FIG. 6.

Additional Applications of the Invention

Each of the embodiments described above is equally well suited for use in a display in which the luminance signal is pulse-width modulated rather than amplitude modulated.

In the active matrix embodiments of FIGS. 1–5, the invention has been described as simultaneously controlling the current flow to all the emitter tips in a pixel. However, the pixel control circuit 20 of the invention can be connected to a single field emitter tip or to a group of emitter tips which is a subset of the emitter tips in an entire pixel. In such case, the control circuit 20 would more accurately be called an emitter current control circuit rather than a pixel control circuit.

Conversely, in the passive matrix embodiments of FIGS. 6–8, the invention has been described as simultaneously controlling the current flow to all the emitter tips in a group of many pixels, namely, all the pixels in one column of a display. In these exemplary embodiments, the control circuit 20 could be called a column current control circuit rather than a pixel control circuit.

The illustrative embodiments described above demonstrate that the present current regulator invention is not limited to any specific circuit topology. The fundamental principle of the invention is controlling the voltage across a back-to-back diode pair in response to a luminance signal, and applying the resulting diode current to a group of field emitter tips so as to control the luminance of a segment of the display. The use of back-to-back diodes promotes superior pixel-to-pixel uniformity, and provides a desirable exponential transfer function between luminance signal and emitter tip current.

We claim:

1. A field emission display having improved brightness uniformity, comprising:

a plurality of emitter groups, each emitter group including a number of emitter tips;

an electrical power source;

a back-to-back diode pair having two diodes connected back-to-back between first and second terminals, the diode pair having a voltage-current transfer characteristic, the first terminal of the diode pair being connected to the electrical power source, and the second terminal of the diode pair being connected to the emitter tips so that substantially all electrical current flow from the emitter tips flows through the diode pair to the power source; and an amplifier circuit having an input connected to receive a luminance signal and having an output connected to the diode pair, wherein the amplifier produces across the diode pair a voltage proportional to the luminance signal;

whereby the current flow between the power source and the emitter tips is a function of the luminance signal, said function being determined by the voltage-current transfer characteristic of the back-to-back diode pair.

2. A display according to claim 1, wherein the amplifier circuit of each emitter group comprises a unity-gain voltage amplifier having an output, an uninverted input, and an inverted input, the amplifier output being connected to the first terminal of the diode pair, the uninverted input being connected to the second terminal of the diode pair, and the inverted input being connected to receive the luminance signal; and the electrical power source connected to the first terminal of the diode pair of each emitter group is the amplifier output connected to said first terminal.

3. A display according to claim 1, wherein the amplifier circuit of each emitter group comprises a field-effect transistor having a source terminal connected to the second terminal of the diode pair, a drain terminal connected to the emitter tips, and a gate terminal; and the luminance signal of each emitter group is a voltage connected between the gate of the transistor and the first terminal of the diode pair.

4. A display according to claim 3, wherein the power source connected to the first terminal of the diode pair of each emitter group is a reference voltage source; and the luminance signal of each emitter group is a voltage connected to the gate of the transistor.

5. A display according to claim 4, wherein the reference voltage source of each emitter group provides a fixed voltage to the first terminal of the diode pair.

6. A display according to claim 4, wherein the reference voltage source of each emitter group provides to the first terminal of the diode pair a voltage whose value is selectable between a first reference voltage and a second reference voltage, wherein the first reference voltage biases the transistor of the emitter group so that the transistor does not conduct current between the emitter tips and the reference voltage source, and wherein the second reference voltage biases the transistor of the emitter group so that the transistor conducts current in proportion to the luminance signal.

7. A display according to claim 3, wherein, within each emitter group, a reference voltage source is connected to the gate of the transistor; and the power source connected to the first terminal of the diode pair includes a circuit for outputting to said first terminal a voltage proportional to the luminance signal inverted;

whereby the power source and the reference voltage source function cooperate so as to apply the luminance signal between the gate of the transistor and the first terminal of the diode pair, whereby the power source functions as a pan of the amplifier which produces across the diode pair a voltage proportional to the luminance signal.

8. A display according to claim 7, wherein the reference voltage source of each emitter group provides a fixed voltage to the gate of the transistor.

9. A display according to claim 7, wherein the reference voltage source of each emitter group provides to the gate of the transistor a voltage whose value is selectable between a first reference voltage and a second reference voltage, wherein the first reference voltage biases the transistor of the emitter group so that the transistor does not conduct current between the emitter tips and the diode pair, and wherein the second reference voltage biases the transistor of the emitter group so that the transistor conducts current in proportion to the luminance signal.

10. A field emission display having improved brightness uniformity, comprising:

a plurality of emitter groups, each emitter group including a number of emitter tips;

a reference voltage source;

a transistor having a source terminal, a drain terminal connected to the emitter tips, and a gate terminal connected to receive a luminance voltage signal; and a back-to-back diode pair having two diodes connected back-to-back between first and second terminals, the first terminal of the diode pair being connected to the source terminal of the transistor, and the second terminal of the diode pair being connected to the reference voltage source.

11. A display according to claim 10, wherein the reference voltage source of each emitter group provides a fixed voltage to the second terminal of the diode pair.

12. A display according to claim 10, wherein the reference voltage source of each emitter group provides to the second terminal of the diode pair a voltage whose value is selectable between a first reference voltage and a second reference voltage, wherein the first reference voltage biases the transistor of the emitter group so that the transistor does not conduct current between the emitter tips and the reference voltage source, and wherein the second reference voltage biases the transistor of the emitter group so that the transistor conducts current in proportion to the luminance signal.

13. A field emission display having improved brightness uniformity, comprising:

a plurality of emitter groups, each emitter group including a number of emitter tips;

a reference voltage source;

a transistor having a source terminal, a drain terminal connected to the emitter tips, and a gate terminal connected to the reference voltage source; and a back-to-back diode pair having two diodes connected back-to-back between first and second terminals, the first terminal of the diode pair being connected to the source terminal of the transistor, and the second terminal of the diode pair being connected to received an inverted luminance voltage signal.

14. A display according to claim 13, wherein the reference voltage source of each emitter group provides a fixed voltage to the second terminal of the diode pair.

15. A display according to claim 13, wherein the reference voltage source of each emitter group provides to the second terminal of the diode pair a voltage whose value is selectable between a first reference voltage and a second reference voltage, wherein the first reference voltage biases the transistor of the emitter group so that the transistor does not conduct current between the emitter tips and the reference voltage source, and wherein the second reference voltage biases the transistor of the emitter group so that the transistor conducts current in proportion to the luminance signal.

* * * * *